US011447853B2

(12) United States Patent
Matsuura

(10) Patent No.: US 11,447,853 B2
(45) Date of Patent: Sep. 20, 2022

(54) WIPING DEVICE AND HOT-DIP PLATING DEVICE USING SAME

(71) Applicant: NIPPON STEEL CORPORATION, Tokyo (JP)

(72) Inventor: Hiroaki Matsuura, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 220 days.

(21) Appl. No.: 16/648,433

(22) PCT Filed: Jul. 24, 2018

(86) PCT No.: PCT/JP2018/027652
§ 371 (c)(1),
(2) Date: Mar. 18, 2020

(87) PCT Pub. No.: WO2019/064860
PCT Pub. Date: Apr. 4, 2019

(65) Prior Publication Data

US 2020/0239994 A1 Jul. 30, 2020

(30) Foreign Application Priority Data

Sep. 29, 2017 (JP) ..... JP2017-191495

(51) Int. Cl.
*C23C 2/20* (2006.01)
*C23C 2/14* (2006.01)
(Continued)

(52) U.S. Cl.
CPC ..... *C23C 2/20* (2013.01); *C23C 2/003* (2013.01); *C23C 2/14* (2013.01); *C23C 2/18* (2013.01); *C23C 2/40* (2013.01)

(58) Field of Classification Search
USPC ..... 118/301, 313, 316, 325, 420, 428, 429, 118/406, 504, 505, 419, 423, 62;
(Continued)

(56) References Cited

U.S. PATENT DOCUMENTS 4,330,574 A * 5/1982 Pierson ..... C23C 2/40 427/319
2018/0251879 A1* 9/2018 Yonekura ..... C23C 2/18

FOREIGN PATENT DOCUMENTS

JP 49-22511 Y1 6/1974
JP 2001-131724 A 5/2001
(Continued)

OTHER PUBLICATIONS

International Search Report for PCT/JP2018/027652 dated Oct. 30, 2018.
(Continued)

*Primary Examiner* — Yewebdar T Tadesse
(74) *Attorney, Agent, or Firm* — Birch, Stewart, Kolasch & Birch, LLP

(57) ABSTRACT

A wiping device 14 includes a pair of wiping nozzles 141, a nozzle mask 142, a rotating pin 1431*a*, a holding portion 1431*b*, and an arm portion 1432. The pair of wiping nozzles 141 is disposed such that nozzle ports 141*a* face each other, the nozzle mask 142 is disposed at both ends of the nozzle ports 141*a* of the wiping nozzles 141, the rotating pin 1431*a* is connected to an upper portion of the nozzle mask 142, the holding portion 1431*b* holds the rotating pin 1431*a*, the arm portion 1432 fixes the holding portion 1431*b* from above, and the rotating pin 1431*a* is rotatable around an axis and adjusts the position of the nozzle mask 142.

20 Claims, 5 Drawing Sheets

(51) Int. Cl.
*C23C 2/18* (2006.01)
*C23C 2/40* (2006.01)
*C23C 2/00* (2006.01)

(58) Field of Classification Search
USPC ..... 427/431, 433, 434.2–434.5, 436
See application file for complete search history.

(56) References Cited

FOREIGN PATENT DOCUMENTS

| | | | |
|---|---|---|---|
| JP | 2009-91630 | A | 4/2009 |
| JP | 2012-219356 | A | 11/2012 |
| TW | 201323099 | A | 6/2013 |

OTHER PUBLICATIONS

Written Opinion of the International Searching Authority for PCT/JP2018/027652 (PCT/ISA/237) dated Oct. 30, 2018.

* cited by examiner

WIPING DEVICE AND HOT-DIP PLATING DEVICE USING SAME

TECHNICAL FIELD OF THE INVENTION

The present invention relates to a wiping device including a wiping nozzle which injects a wiping gas from a nozzle port formed along a width direction of a steel sheet pulled up from a hot-dip plating bath toward the steel sheet, and a hot-dip plating device using the same.

Priority is claimed on Japanese Patent Application No. 2017-191495, filed Sep. 29, 2017, the content of which is incorporated herein by reference.

RELATED ART

As a device for plating a long steel sheet, a continuous hot-dip plating device is known. This hot-dip plating device includes a hot-dip plating bath in which a pickled steel sheet is immersed, a sink roll which changes a traveling direction of the steel sheet toward a bottom part of the hot-dip plating bath to an upward direction, and an alloying furnace which rapidly heats the pulled steel sheet.

The hot-dip plating device includes wiping nozzles, which are disposed on both sides across the steel sheet, inject a wiping gas so as to wipe out excessive molten metal, and controls an adhered amount of the molten metal such that the molten metal adhering to a surface of the steel sheet has a uniform thickness in a width direction and a longitudinal direction of the steel sheet.

As the wiping nozzle of the hot-dip plating device, a wiping nozzle described in Patent Document 1 is known.

The wiping device described in Patent Document 1 and a hot-dip plating device using the same include a mask (nozzle mask) which covers the wiping nozzle located outside a steel sheet. By providing this nozzle mask, it is possible to prevent occurrence of a turbulent flow caused by collision of the wiping gas blown from the facing wiping nozzles at an outer portion of the steel sheet.

PRIOR ART DOCUMENT

Patent Document

[Patent Document 1] Japanese Unexamined Patent Application, First Publication No. 2012-219356

DISCLOSURE OF THE INVENTION

Problems to be Solved by the Invention

In the wiping nozzle described in Patent Document 1, a moving frame which holds a mask support rod supporting the nozzle mask in a state where the mask support rod is suspended is movable in the width direction of the steel sheet by a ball screw, and the injection of the wiping gas is controlled by covering the nozzle port of the wiping nozzle with the nozzle mask so as to cover the nozzle port. Here, if the nozzle mask does not appropriately cover the wiping nozzle at an edge portion of the steel sheet and the injection of wiping gas from the wiping nozzle cannot be controlled, a jet which collides with the edge portion of the steel sheet escapes in a lateral direction. Accordingly, a collision force of the jet decreases, and thus, a so-called edge overcoat may be generated, in which a plating thickness of the edge portion is thicker than that of a center portion.

Alternatively, a so-called splash may be generated, in which the molten metal is scattered around due to disturbance of the jet colliding with the edge portion. Accordingly, in order to cover the nozzle port of the wiping nozzle with the nozzle mask so as to reliably control the injection of the wiping gas, a positional relationship between the wiping nozzle and the nozzle mask is important.

For example, when steel sheets having different widths are plated, it is necessary to change a position of the wiping nozzle covered by the nozzle mask according to a width of a new steel sheet, and thus, an attachment position of the nozzle mask is adjusted. Moreover, when a maintenance is performed, the nozzle mask and the wiping nozzle are once removed and attached after a maintenance work.

In this case, the nozzle mask may be attached in a state where the nozzle mask is inclined with respect to the wiping nozzle, or the wiping nozzle may be attached in an inclined state such that one end side of the wiping nozzle disposed along the width direction of the steel sheet approaches the steel sheet and the other end side thereof is separated from the steel sheet.

If the nozzle mask or the wiping nozzle is attached in the inclined state, the nozzle mask which moves parallel to the surface of the steel sheet by the ball screw is caught by the wiping nozzle when the nozzle mask moves to one side, and thus, the nozzle mask cannot move in parallel up to a predetermined position. Accordingly, the wiping mask cannot be disposed at an appropriate position or a space between the nozzle mask and the wiping nozzle increases when the wiping mask moves to the other side, a gap is generated, and thus, the wiping nozzle is not appropriately covered.

Therefore, the above-described edge overcoat or splash is generated.

Accordingly, an object of the present invention is to provide a wiping device capable of allowing the nozzle mask to appropriately follow an orientation of the wiping nozzle to cover the wiping nozzle even if a relative positional relationship between the wiping nozzle and the nozzle mask is changed, and a hot-dip plating device using the same.

Means for Solving the Problem (1) According to an aspect of the present invention, there is provided a wiping device including: a pair of wiping nozzles; a nozzle mask; a rotating pin; a holding portion; and an arm portion, in which the pair of wiping nozzles is disposed such that nozzle ports face each other, the nozzle mask is disposed at both ends of the nozzle ports of the wiping nozzles, the rotating pin is connected to an upper portion of the nozzle mask, the holding portion holds the rotating pin, the arm portion fixes the holding portion from above, and the rotating pin is rotatable around an axis and adjusts the position of the nozzle mask.

According to the wiping device having the above-described configuration, even when the wiping nozzle is installed in a state where an installation angle with respect to a steel sheet is inclined, the orientation of the nozzle mask is also rotated around the axis by the rotating pin according to an inclination of the wiping nozzle, and thus, the same relative angle can be always maintained. Accordingly, the nozzle mask can always cover the nozzle port of the wiping nozzle at the same relative angle. Accordingly, it is possible to prevent occurrence of edge overcoat and splash, and it is possible to form a plated layer having a uniform thickness of the steel sheet in a longitudinal direction.

(2) In another aspect of the present invention, in the wiping device described in (1), the wiping device further including: a support portion; and a spring, in which the arm portion is oscillatably connected to the support portion, the spring is suspended between the support portion and the arm portion, and the nozzle mask is biased in a direction of the wiping nozzle by the spring. Accordingly, it is possible to prevent the nozzle mask from being pushed out to the steel sheet side due to a wiping gas injected from the nozzle port. In addition, even when the wiping nozzle is inclined in a direction separated from the steel sheet and a gap between the steel sheet and the wiping nozzle increases, a state where the nozzle mask is close to the wiping nozzle can be maintained.

(3) In still another aspect of the present invention, in the wiping device described in (1) or (2), the holding portion is rotatably connected to the arm portion, and the arm portion and the holding portion are fixed to each other by a bolt. Accordingly, it is possible to set an angle of the nozzle mask with respect to the arm portion. Accordingly, even when the nozzle port of the wiping nozzle is inclined upward or downward, the state where the nozzle mask is close to the wiping nozzle can be maintained, and it is possible to reliably cover the nozzle port of the wiping nozzle with the nozzle mask.

(4) In still another aspect of the present invention, in the wiping device described in any one of (1) to (3), the holding portion includes a projection pin, and the arm portion includes a pin receiving portion into which the projection pin is inserted. Accordingly, even when the wiping nozzle is installed to be inclined in a state where one end of the wiping nozzle is located above or below the other end thereof, the state where the nozzle mask is close to the wiping nozzle can be maintained, and it is possible to reliably cover the nozzle port of the wiping nozzle with the nozzle mask.

(5) In still another aspect of the present invention, in the wiping device described in any one of (1) to (4), the holding portion has a through-hole into which the rotating pin is inserted and movably holds the rotating pin along an axial direction of the rotating pin. Accordingly, even when the position of the wiping nozzle is changed to be parallel to the axial direction of the rotating pin, the rotating pin moves in the axial direction according to the position of the wiping nozzle. Therefore, even when the wiping nozzle moves in the axial direction of the rotating pin, the nozzle mask can follow the wiping nozzle together with the rotating pin by the holding portion.

(6) According to still another aspect of the present invention, there is provided a hot-dip plating device including: the wiping device according to any one of (1) to (5). The hot-dip plating device includes the wiping device of the present invention. Accordingly, even when the relative position between the wiping nozzle and the nozzle mask is changed, it is possible to reliably cover the nozzle port of the wiping nozzle with the nozzle mask.

Effects of the Invention

According to the wiping device described in each aspect, the nozzle mask can always cover the nozzle port of the wiping nozzle at the same relative angle. Accordingly, it is possible to prevent occurrence of the edge overcoat and splash, and it is possible to form a plated layer having a uniform thickness of the steel sheet in the longitudinal direction.

EMBODIMENTS OF THE INVENTION

Hereinafter, a wiping device according to an embodiment of the present invention and a hot-dip plating device using the wiping device will be described with reference to the drawings. In addition, it is obvious that the present invention is not construed as being limited to the following embodiments.

Figure 1:
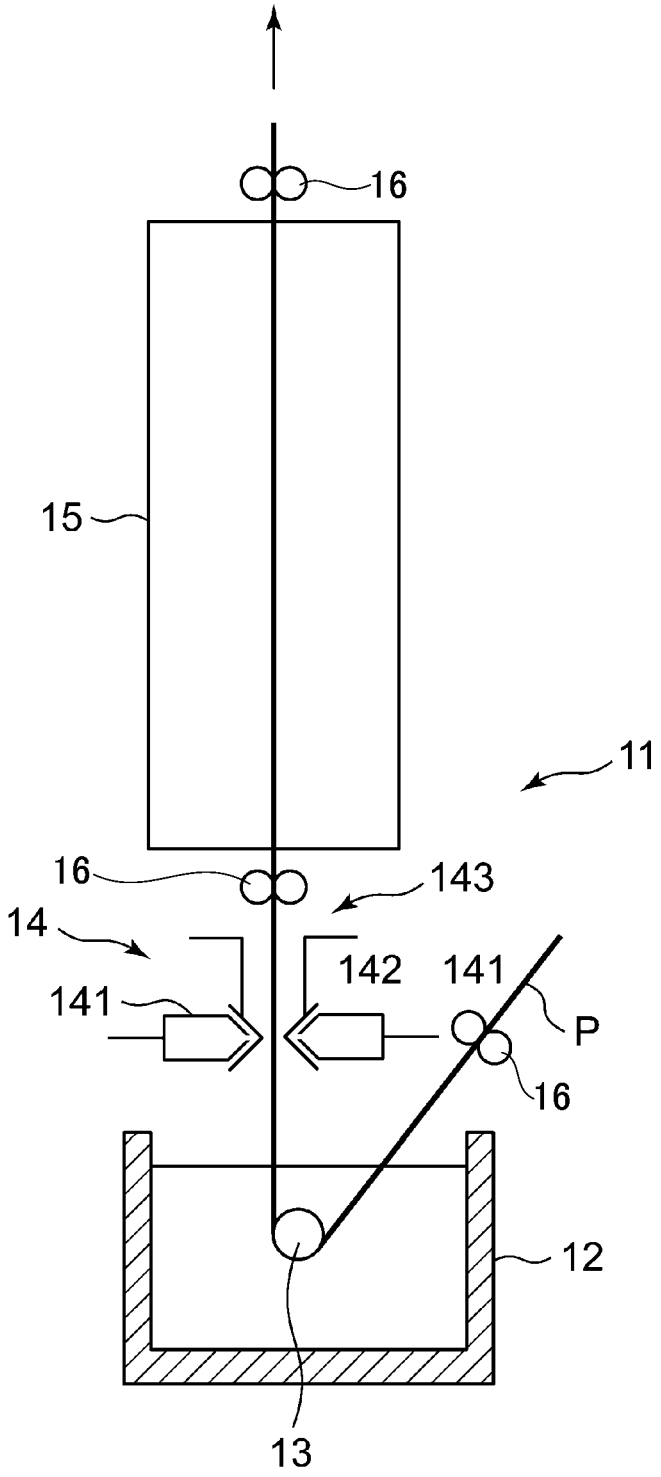
FIG. 1 is a schematic view showing a hot-dip plating device according to an embodiment of the present invention.

As shown in FIG. 1, a hot-dip plating device 11 according to an embodiment of the present invention includes a hot-dip plating bath 12 in which a pickled steel sheet P is immersed, a sink roll 13 which changes a traveling direction of the steel sheet P toward a bottom part of the hot-dip plating bath 12 to an upward direction, a wiping device 14 which includes a pair of wiping nozzles 141 disposed to face each other on both sides across the steel sheet, and an alloying furnace 15 which rapidly heats the pulled steel sheet P. The steel sheet P is conveyed in an order of the hot-dip plating bath 12, the wiping device 14, and the alloying furnace 15 while being guided by a conveyance roll 16.

Figure 2:
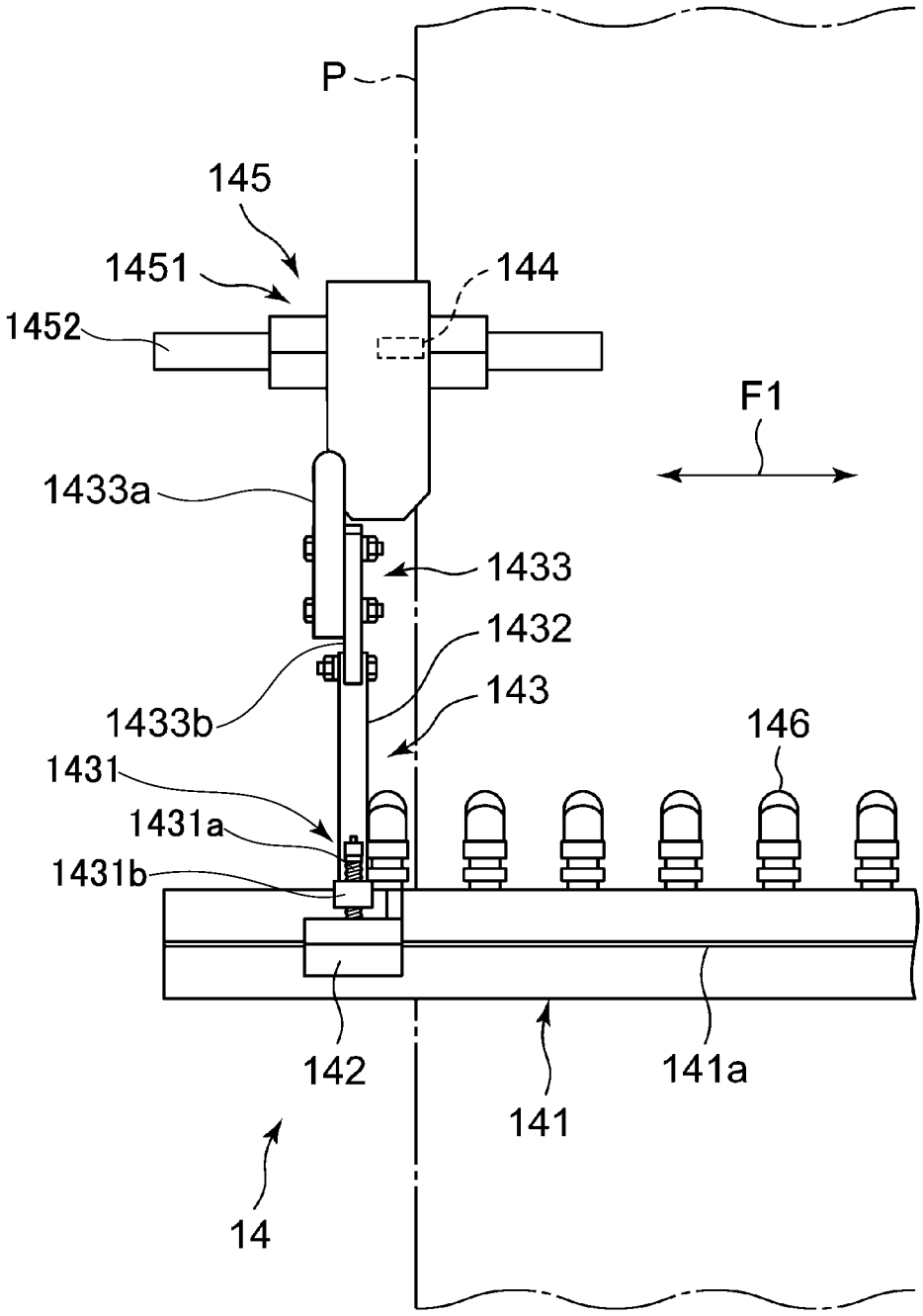
FIG. 2 is a front view for explaining a wiping device of the hot-dip plating device shown in FIG. 1 and is a view when viewed in a direction perpendicular to a surface of a steel sheet.
Figure 3:
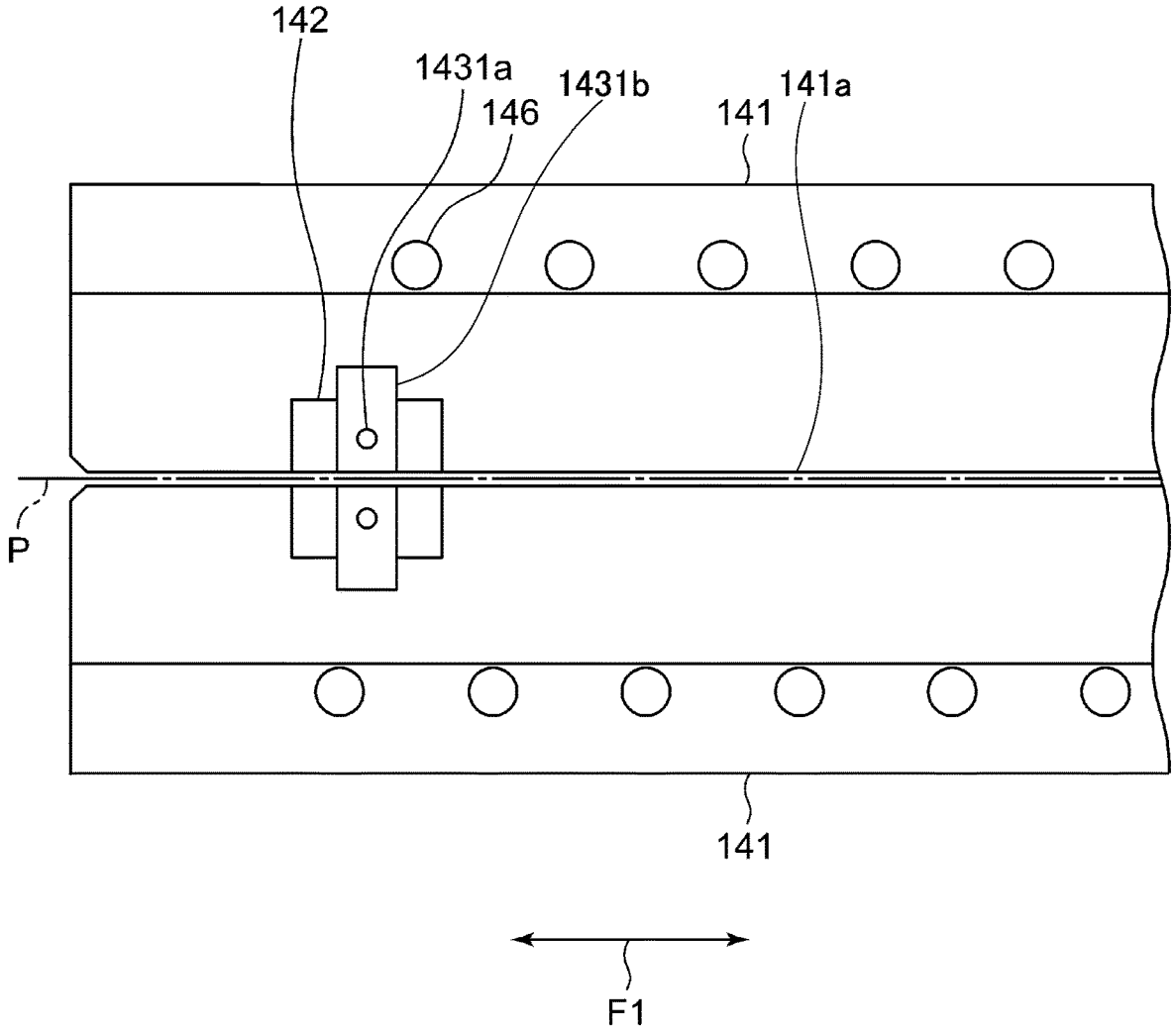
FIG. 3 is a plan view for explaining the wiping device of the hot-dip plating device shown in FIG. 1 and is a view when viewed from above the wiping device along a conveyance direction of the steel sheet.

An example of the wiping device 14 according to the present embodiment is shown in FIGS. 2 and 3.

The wiping device 14 according to the present embodiment includes the pair of wiping nozzles 141, a nozzle mask 142, a rotating pin 1431*a*, a holding portion 1431*b*, and an arm portion 1432. Nozzle ports 141*a* of the pair of wiping nozzles 141 are disposed to face each other, the nozzle mask 142 is disposed at both ends of the nozzle port 141*a* of the wiping nozzle 141, the rotating pin 1431*a* is connected to an upper portion of the nozzle mask 142, the holding portion 1431*b* holds the rotating pin 1431*a*, the arm portion 1432 fixes the holding portion 1431*b* from above, the rotating pin 1431*a* is rotatable around an axis, and a position of the nozzle mask 142 is adjusted.

The wiping device 14 of the present embodiment includes at least the wiping nozzle 141 which injects a wiping gas toward a steel sheet P (steel sheet P is indicated by a dash-dot line in FIGS. 2 to 4) and wipes out molten metal excessively adhering to a surface of the steel sheet P, the nozzle mask 142 which covers a portion of an injection port (nozzle port 141*a*) of the wiping nozzle 141, and a support mechanism 143 which supports the nozzle mask 142.

In addition, the wiping device 14 according to the present embodiment may further include a sensor 144 which detects an end portion (edge portion) in a width direction F1 of the steel sheet P, a moving mechanism 145 which moves the nozzle mask 142 according to a signal from the sensor 144, and an edge position controller (not shown) which controls the moving mechanism 145.

<Wiping Nozzle>

The wiping nozzles 141 shown in FIGS. 2 to 5 are disposed such that the nozzle ports 141*a* are face each other along the width direction F1 of the steel sheet P on both sides across the steel sheet P. The length of the wiping nozzle 141 in the width direction F1 can be determined appropriately depending on a width of the steel sheet P, and for example, may be about 1000 mm to about 2000 mm.

In the wiping nozzle 141, a slit is formed in a tip end portion facing the steel sheet P side along the width direction F1 of the steel sheet P. This slit is the nozzle port 141*a* which injects wiping gas.

The wiping nozzle 141 is formed in a tapered shape such that a space between steel materials forming the wiping nozzle 141 is gradually narrowed toward the nozzle port 141*a*. That is, the wiping nozzle 141 has a cross-sectional shape in a plane perpendicular to a longitudinal direction of the wiping nozzle 141 as shown in FIGS. 2 to 5.

Pipes 146 for supplying wiping gas are connected to a rear surface side of the wiping nozzle 141 side by side. For example, the wiping gas having a discharge pressure of about 50 to 200 kPa is ejected from the nozzle port 141*a*.

<Nozzle Mask>

The nozzle mask 142 shown in FIGS. 2 and 3 is disposed to cover the nozzle port 141*a* at portions located on both outer sides of the width direction F1 of the steel sheet P in the longitudinal direction of the wiping nozzle 141. The nozzle mask 142 is formed by bending a rectangular plate material in accordance with an inclination angle of a tip end portion of the wiping nozzle 141, at a position at which a straight portion located in the nozzle port 141*a* is bent.

Therefore, the nozzle mask 142 is convex toward the steel sheet P such that a space between plate members gradually is narrowed from an opening side toward the bent position located at the nozzle port 141*a*. That is, the nozzle mask 142 has a cross-sectional shape in a plane perpendicular to the longitudinal direction of the wiping nozzle 141 as shown in FIGS. 2 to 5.

<Support Mechanism>

Figure 4:
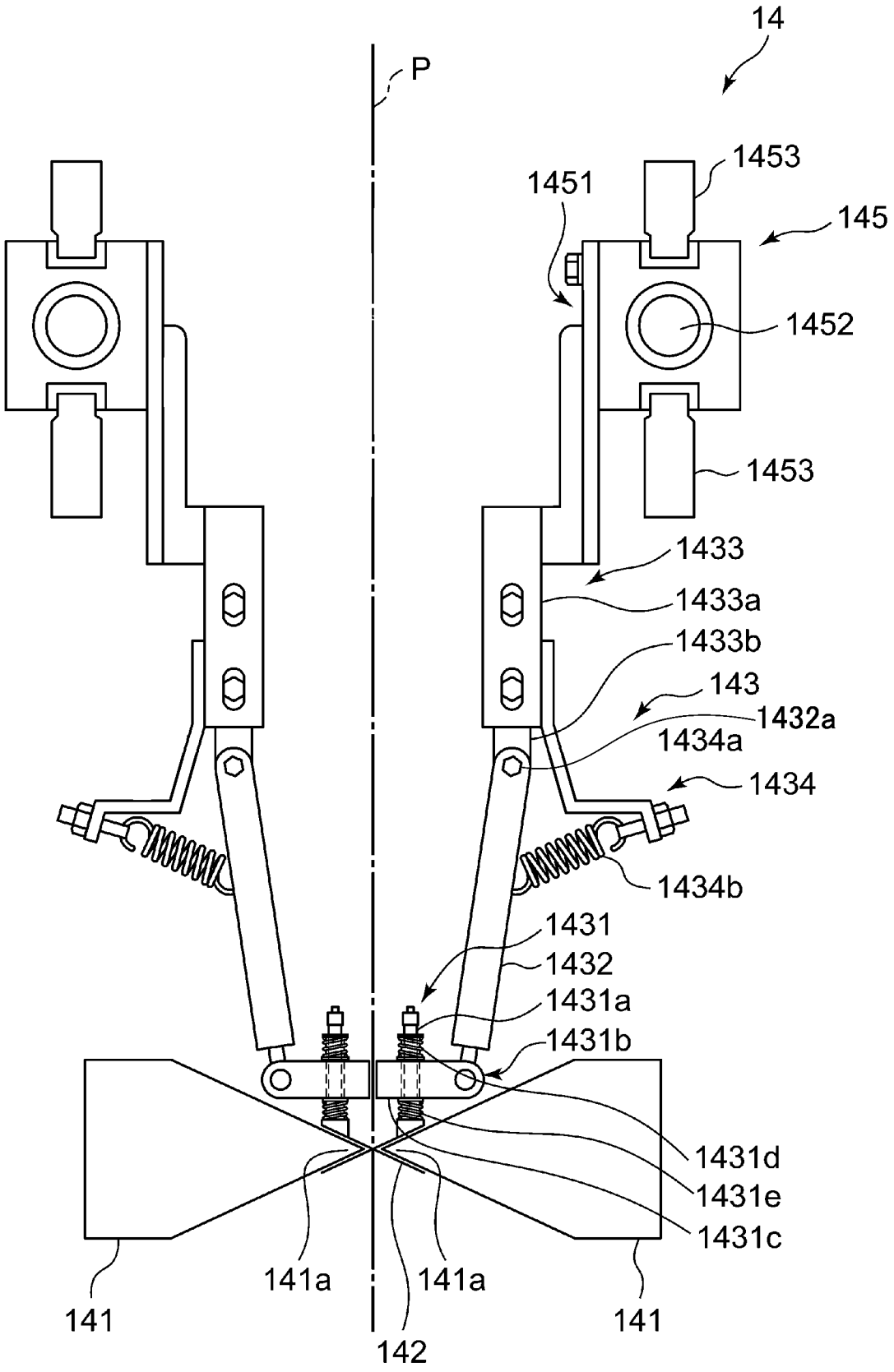
FIG. 4 is a side view for explaining the wiping device of the hot-dip plating device shown in FIG. 1 and is a view when viewed in a direction parallel to the surface of the steel sheet.

The support mechanism 143 shown in FIG. 4 includes at least a connection mechanism 1431 which connected to the nozzle mask 142, the arm portion 1432 which extends upward from the connection mechanism 1431, and a support portion 1433 which connects the arm portion 1432 to the moving mechanism 145.

(Connection Mechanism)

Figure 5:
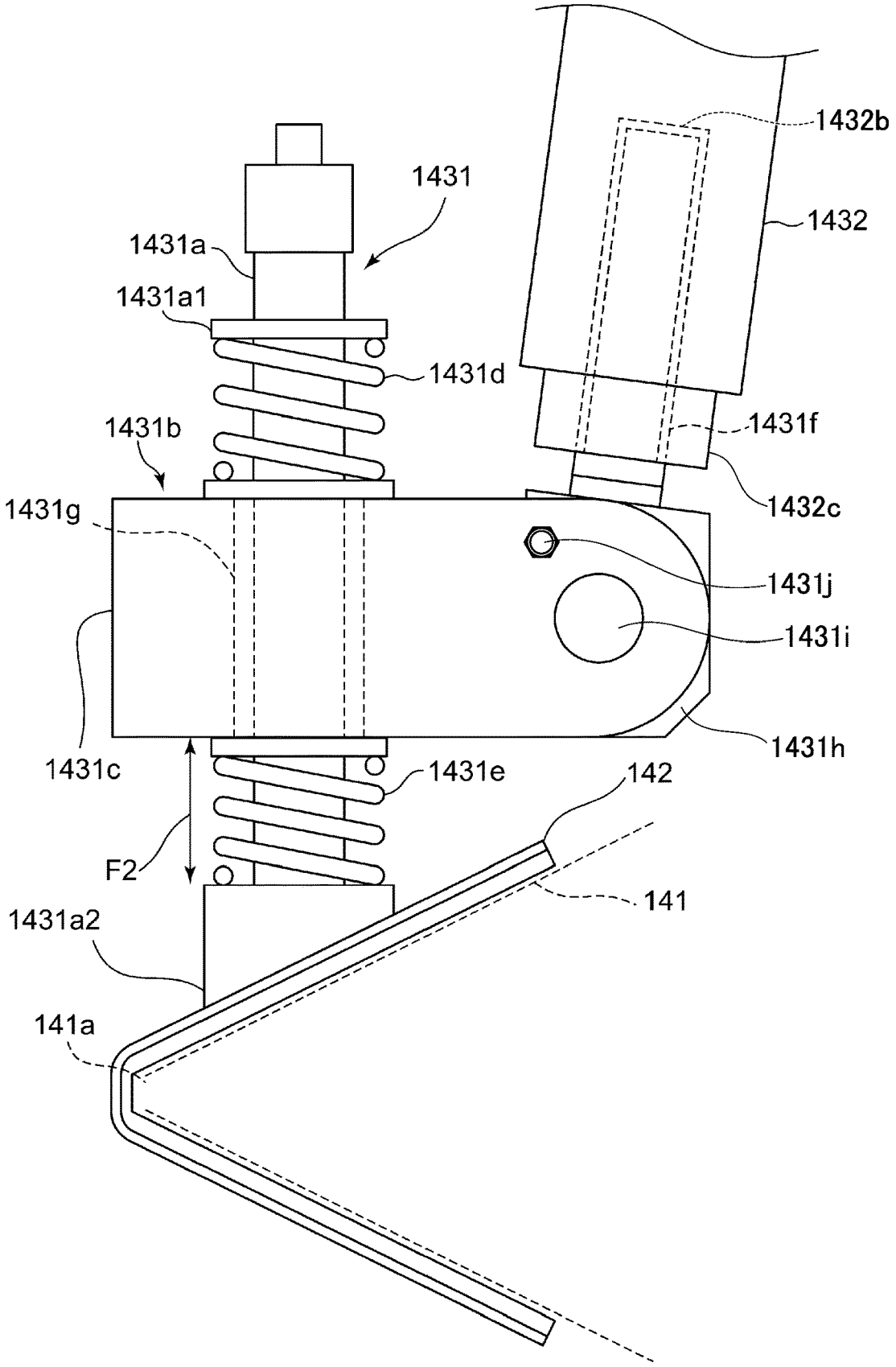
FIG. 5 is a side view for explaining a nozzle mask and a support mechanism of the wiping device shown in FIG. 4.

The connection mechanism 1431 shown in FIGS. 4 and 5 includes a holding portion 1431*b* and rotating pins 1431*a* which connect the holding portion 1431*b* and the nozzle mask 142 to each other. An orientation of the nozzle mask 142 with respect to the wiping nozzle 141 can be changed by the connection mechanism 1431 in accordance with a relative positional relationship between the wiping nozzle 141 and the nozzle mask 142.

The holding portion 1431*b* holds the rotating pin 1431*a* such that the rotating pin 1431*a* is movable along an axial direction F2 of the rotating pin 1431*a* and is rotatable around an axis of the rotating pin 1431*a*.

A through-hole 1431*g* into which the rotating pin 1431*a* is inserted is formed in the holding portion 1431*b* shown in FIG. 5, and the holding portion 1431*b* includes a guide portion 1431*c* which allows the rotating pin 1431*a* to be movable in the axial direction F2, a pair of coil springs (spring 1431*d* and spring 1431*e*) as an example of an elastic member which holds the rotating pin 1431*a* in a state where the rotating pin 1431*a* is inserted into the coil springs, both sides of the rotating pin 1431*a* across the guide portion 1431*c*, and a connection portion 1431*h* which is connected to the guide portion 1431*c*.

A projection pin 1431*f* for connecting the holding portion 1431*b* to one end of the arm portion 1432 is connected to the connection portion 1431*h* of the holding portion 1431*b* shown in FIG. 5.

The guide portion 1431*c* and the connection portion 1431*h* are rotatably connected to each other by a first shaft member 1431*i*. By rotating the guide portion 1431*c* around an axis of the first shaft member 1431*i*, it is possible to set an angle of the guide portion 1431*c* with respect to the arm portion 1432. A direction of the axis of the first shaft member 1431*i* is a direction perpendicular to a paper surface of FIG. 5.

The guide portion 1431*c* and the connection portion 1431*h* can be fixed to each other by tightening a fixing bolt 1431*j* inserted through the guide portion 1431*c* with respect to the connection portion 1431*h*.

As described above, in the wiping device 14 according to the present embodiment, the holding portion 1431*b* may be rotatably connected to the arm portion 1432, and the arm portion 1432 and the holding portion 1431*b* may be fixed by a bolt (fixing bolt 1431*j*). Accordingly, it is possible to set an angle of the nozzle mask 142 with respect to the arm portion 1432. Accordingly, even when the nozzle port 141*a* of the wiping nozzle 141 is inclined upward or downward, a state where the nozzle mask 142 is close to the wiping nozzle 141 can be maintained, and it is possible to reliably cover the nozzle port 141*a* of the wiping nozzle 141 with the nozzle mask 142.

In the upper spring 1431*d* shown in FIG. 5, a movement of an upper end in the axial direction F2 is restricted by a flange portion 1431*a*1 of the rotating pin 1431*a* and a movement of a lower end in the axial direction F2 is restricted by the guide portion 1431*c*. In the lower spring 1431*e*, a movement of a lower end in the axial direction F2 is restricted by a diameter-increasing portion 1431*a*2 of the rotating pin 1431*a* and a movement of an upper end in the axial direction F2 is restricted by the guide portion 1431*c*. In this way, each of the springs 1431*d* and 1431*e* oscillatably holds the rotating pin 1431*a* along the axial direction F2.

Moreover, in the present embodiment, the springs 1431*d* and 1431*e* hold the rotating pin 1431*a* by balancing respective stretching forces of the springs 1431*d* and 1431*e*. However, the upper spring and the lower spring may hold the rotating pin 1431*a* by balancing contraction forces of the upper and lower springs.

Moreover, in the wiping device 14 according to the present embodiment, the holding portion 1431*b* has the through-hole 1431*g* into which the rotating pin 1431*a* is inserted and may movably hold the rotating pin 1431*a* along the axial direction F2 of the rotating pin 1431*a*. Accordingly, even when the position of the wiping nozzle 141 is changed to be parallel to the axial direction F2 of the rotating pin 1431*a*, the rotating pin 1431*a* moves in the axial direction F2 according to the position of the wiping nozzle 141. Therefore, even when the wiping nozzle 141 moves in the axial direction F2 of the rotating pin 1431*a*, the nozzle mask 142 can follow the wiping nozzle 141 together with the rotating pin 1431*a* by the holding portion 1431*b*.

(Arm Portion)

The arm portion 1432 shown in FIG. 4 is formed in a square bar shape. One end portion of the arm portion 1432 is connected to the support portion 1433 by a second shaft member 1432*a*. The other end portion of the arm portion 1432 has a pin receiving portion 1432*b* into which the projection pin 1431*f* (see FIG. 5) of the holding portion 1431*b* is inserted. The holding portion 1431*b* and the arm portion 1432 are connected to each other via the projection pin 1431*f* inserted into the pin receiving portion 1432*b*.

The second shaft member 1432*a* is inserted into the arm portion 1432 and the support portion 1433. An axial direction of the second shaft member 1432*a* is parallel to an axial direction (direction perpendicular to a paper surface of FIG. 4) of a ball screw 1452 described later, and thus, the arm portion 1432 may be oscillatably connected to the support portion 1433 in a plane perpendicular to the axial direction of the ball screw 1452. Moreover, the second shaft member 1432*a* may be constituted by a bolt and a nut such that the arm portion 1432 and the support portion 1433 may be fixed to each other by fastening the bolt and the nut to each other.

Threads may be provided on an outer periphery of the projection pin 1431*f* and an inner periphery of the pin receiving portion 1432*b* such that the projection pin 1431*f* and the pin receiving portion 1432*b* are screwed to each other. It is possible to adjust a distance between the arm portion 1432 and the holding portion 1431*b* by adjusting the length of the projection pin 1431*f* inserted into the pin receiving portion 1432*b*. Moreover, the arm portion 1432 and the holding portion 1431*b* may be fixed to each other by a nut 1432*c* screwed to the projection pin 1431*f*.

Alternatively, the threads are not provided on the outer periphery of the projection pin 1431*f* and the inner periphery of the pin receiving portion 1432*b*, and the projection pin 1431*f* may be fixed to an inside of the pin receiving portion 1432*b* by a bolt or the like inserted into a direction perpendicular to a longitudinal direction of the arm portion 1432.

As described above, in the wiping device 14 according to the present embodiment, the holding portion 1431*b* may include the projection pin 1431*f*, and the arm portion 1432 may include the pin receiving portion 1432*b* through which the projection pin 1431*f* is inserted. Accordingly, even when the wiping nozzle 141 is installed to be inclined in a state where one end of the wiping nozzle 141 is located above or below the other end thereof, the state where the nozzle mask 142 is close to the wiping nozzle 141 can be maintained, and it is possible to reliably cover the nozzle port 141*a* of the wiping nozzle 141 with the nozzle mask 142.

(Support Portion)

The support portion 1433 shown in FIG. 4 is formed by integrally fixing a first support bar 1433*a* and the second support bar 1433*b* to each other by a bolt and a nut. The first support bar 1433*a* is fixed to the moving mechanism 145, and the second support bar 1433*b* is connected to the arm portion 1432.

In addition, in the present embodiment, the support portion 1433 includes the first support bar 1433*a* and the second support bar 1433*b*. However, the support portion 1433 may include only the first support bar 1433*a*, and the first support bar 1433*a* may be connected to the moving mechanism 145 and the arm portion 1432.

(Spring Mechanism)

A spring mechanism 1434 shown in FIG. 4 includes a spring support base 1434*a* and a coil spring (hereinafter, referred to as a spring 1434*b*) which an example of an elastic member. One end of the spring support base 1434*a* is connected to the support portion 1433 and the other end thereof is connected to the spring 1434*b*. The spring 1434*b* is suspended between the spring support base 1434*a* and the arm portion 1432, and the nozzle mask 142 can be guided in the direction of the wiping nozzle 141 by pulling the arm portion 1432 toward the spring support base 1434*a*.

One end portion of the arm portion 1432 is connected to the support portion 1433 via the second shaft member 1432*a*, and thus, the arm portion 1432 is oscillatably connected to the support portion 1433. Moreover, the spring 1434*b* is suspended between the support portion 1433 and the arm portion 1432 via the spring support base 1434*a*, and thus, it is possible to bias the nozzle mask 142 in a direction of the wiping nozzle 141 by an elastic force (contraction force in the configuration of FIG. 4) of the spring 1434*b*.

As described above, the wiping device 14 according to the present embodiment further includes the support portion 1433 and the spring 1434*b*, the arm portion 1432 is oscillatably connected to the support portion 1433, the spring 1434*b* is suspended between the support portion 1433 and the arm portion 1432, and the wiping device 14 may be configured such that the nozzle mask 142 is biased in the direction of the wiping nozzle 141 by the spring 1434*b*. Accordingly, it is possible to prevent the nozzle mask 142 from being pushed out to the steel sheet P side due to the wiping gas injected from the nozzle port 141*a*. In addition, even when the wiping nozzle 141 is inclined in a direction separated from the steel sheet P and a gap between the steel sheet P and the wiping nozzle 141 increases, the state where the nozzle mask 142 is close to the wiping nozzle 141 can be maintained.

<Sensor>

The sensor 144 shown in FIG. 2 detects an end portion of the steel sheet P in the width direction F1, and thus, detects a position of the steel sheet P in the width direction F1.

<Moving Mechanism>

The moving mechanisms 145 shown in FIG. 4 includes a moving frame 1451 which is connected to the support portion 1433, a ball screw 1452 which moves the moving frame 1451 in parallel to the width direction F1 of the steel sheet P, a pair of upper and lower guide rails 1453 which supports the moving frame 1451, and a drive unit (not shown) which rotates a screw shaft of the ball screw 1452.

According to the wiping device 14 of the present embodiment, even when the wiping nozzle 141 is installed in a state where an installation angle with respect to the steel sheet is inclined, the orientation of the nozzle mask 142 is also rotated around the axis by the rotating pin 1431*a* according to the inclination of the wiping nozzle 141, and thus, the same relative angle can be always maintained. Accordingly, the nozzle mask 142 can always cover the nozzle port 141*a* of the wiping nozzle 141 at the same relative angle. Accordingly, it is possible to prevent occurrence of edge overcoat and splash, and it is possible to form a plated layer having a uniform thickness of the steel sheet in the longitudinal direction.

In addition, even when the relative positional relationship between the wiping nozzle 141 and the nozzle mask 142 is changed, it is possible to change the orientation of the nozzle mask 142 with respect to the wiping nozzle 141. Accordingly, as before the positional relationship is changed, the nozzle mask 142 can be moved to the state where the nozzle mask 142 is close to the wiping nozzle 141, and thus, it is possible to reliably cover the nozzle port 141*a* of the wiping nozzle 141 with the nozzle mask 142.

An operation and a use state of the wiping device 14 according to the embodiment configured as described above will be described with reference to the drawings.

The traveling direction of the steel sheet P immersed in the molten metal in the hot-dip plating bath 12 shown in FIG. 1 is changed to the upward direction by the sink roll 13, and thus, the steel sheet P is pulled up from the hot-dip plating bath 12. The steel sheet P pulled up from the hot-dip plating bath 12 passes through a portion between the pair of wiping nozzles 141.

When the steel sheet P shown in FIGS. 2 and 3 is moved in the width direction F1, the sensor 144 detects this movement. Accordingly, the drive unit of the moving mechanism 145 shown in FIG. 4 rotates the screw shaft of the ball screw 1452, and the moving frame 1451 is moved in parallel along the guide rail 1453 according to the movement of the steel sheet P. Due to the parallel movement of the moving frame 1451, the nozzle mask 142 connected to the moving frame 1451 is moved in parallel through the support mechanism 143. Accordingly, even when the steel sheet P moves in the width direction F1, the nozzle mask 142 is maintained so as to cover portions located on both outer sides of the wiping nozzle 141 in the width direction F1 of the steel sheet P. Accordingly, it is possible to suppress occurrence of a turbulent flow caused by collision of the wiping gases ejected by the facing wiping nozzles 141 at a position of an end portion of the steel sheet P, that is, at a position of an end portion of the wiping nozzle 141 in the longitudinal direction.

In addition, when the plating is performed by switching to a steel sheet P having a different plate width, an attachment position of the nozzle mask 142 is adjusted. In this case, the nozzle mask 142 is attached in a state where the nozzle mask 142 is inclined to the wiping nozzle 141. Accordingly, the relative positional relationship between the wiping nozzle 141 and the nozzle mask 142 may be changed and an inclination may occur.

However, as shown in FIG. 4, in the wiping device 14 of the above-described embodiment, the holding portion 1431*b* rotatably holds the rotating pin 1431*a*. Accordingly, even when the nozzle mask 142 is moved while sliding on the wiping nozzle 141 by the moving mechanism 145, a head of the holding portion 1431*b* swings at a tip of the arm portion 1432, and the nozzle mask 142 follows the inclination of the wiping nozzle 141. Accordingly, it is possible to prevent a large gap from occurring between the nozzle mask 142 and the wiping nozzle 141, and it is possible to reliably cover the nozzle port 141*a* of the wiping nozzle 141 with the nozzle mask 142.

Moreover, the arm portion 1432 is pulled by the spring 1434*b* of the spring mechanism 1434 shown in FIG. 4, and thus, the nozzle mask 142 is guided in the direction of the wiping nozzle 141. Accordingly, the nozzle mask 142 is brought close to the wiping nozzle 141 with an appropriate pressing force.

Accordingly, since the state where the nozzle mask 142 is close to the wiping nozzle 141 can be maintained, it is possible to more reliably cover the nozzle port 141*a* with the nozzle mask 142.

For example, in the wiping device 14 in which the wiping gas from the wiping nozzle 141 is ejected at a discharge pressure of about 50 to 200 kPa, a spring force of the spring 1434*b* which causes the nozzle mask 142 to be close to the wiping nozzle 141 may be 10 kgf to 30 kgf (98.1 N to 294.3 N).

If the spring force of the spring 1434*b* is 10 kgf or more, the nozzle mask 142 can be prevented from floating from the wiping nozzle 141 due to the pressure of the wiping gas from the wiping nozzle 141, and it is possible to prevent a proximity between the wiping nozzle 141 and the wiping gas from decreasing. Further, if the spring force is 30 kgf or less, even when the nozzle mask 142 is moved while sliding on the wiping nozzle 141 by the moving mechanism 145, it is possible to prevent the nozzle mask 142 from being caught by the wiping nozzle 141. Therefore, it is more preferably that the spring force of the spring 1434*b* is 10 kgf to 30 kgf.

If the wiping nozzle 141 (indicated by dotted lines in FIG. 5) shown in FIG. 5 moves in parallel to the axial direction F2 (up-down direction) of the rotating pin 1431*a*, the nozzle mask 142 and the rotating pin 1431*a* try to move in the up-down direction according to the position of the wiping nozzle 141. Since the rotating pin 1431*a* connected to the nozzle mask 142 is guided in the up-down direction by the guide portion 1431*c* fixed by the arm portion 1432, the nozzle mask 142 can follow the wiping nozzle 141 even if the position of the wiping nozzle 141 is changed.

Moreover, when the nozzle mask 142 moves along the axial direction F2 of the rotating pin 1431*a*, each of the springs 1431*d* and 1431*e* located above and below presses the rotating pin 1431*a* in the direction of the guide portion 1431*c*. Therefore, the nozzle mask 142 presses the inclined surface outside the wiping nozzle 141 from either the up direction or the down direction according to the change of the position of the wiping nozzle 141 in the up-down direction. Accordingly, the nozzle mask 142 not only presses the wiping nozzle 141 horizontally by the spring 1434*b* but also presses the wiping nozzle 141 from either the up direction or the down direction by the springs 1431*d* and 1431*e*, and thus, the nozzle mask 142 can be brought close to the wiping nozzle 141 with a stronger pressing force.

As described above, according to the wiping device 14 of the above-described embodiment, the wiping device 14 includes the pair of wiping nozzles 141, the nozzle mask 142, the rotating pin 1431*a*, the holding portion 1431*b*, and the arm portion 1432, the pair of wiping nozzles 141 is disposed such that the nozzle ports 141*a* face each other, the nozzle mask 142 is disposed at both ends of the nozzle ports 141*a* of the wiping nozzles 141, the rotating pin 1431*a* is connected to an upper portion of the nozzle mask 142, the holding portion 1431*b* holds the rotating pin 1431*a*, the arm portion 1432 fixes the holding portion 1431*b* from above, and the rotating pin 1431*a* is rotatable around the axis and adjusts the position of the nozzle mask 142.

Therefore, even when the wiping nozzle 141 is installed in the state where the installation angle with respect to the steel sheet is inclined, the orientation of the nozzle mask 142 is also rotated around the axis by the rotating pin 1431*a* according to an inclination of the wiping nozzle 141, and thus, the same relative angle can be always maintained. Accordingly, the nozzle mask 142 can always cover the nozzle port 141*a* of the wiping nozzle 141 at the same relative angle, it is possible to prevent occurrence of the edge overcoat and the splash, and it is possible to form a plated layer having a uniform thickness of the steel sheet in the longitudinal direction.

Moreover, in the above-described embodiment, the rotating pin 1431*a* is connected to the nozzle mask 142, and the arm portion 1432 and the holding portion 1431*b* are connected to each other. On the other hand, a mechanism corresponding to the holding portion of the above-described embodiment may be provided on the nozzle mask 142 side, and a mechanism corresponding to the rotating pin of the above-described embodiment may be provided on the arm portion 1432 side. Moreover, the nozzle mask 142 and the arm portion 1432 may be connected to each other by providing the rotating pins on both the nozzle mask 142 side and the arm portion 1432 side and holding both rotating pins by the holding portion.

Further, the rotation mechanism of the connection mechanism 1431 may be any mechanism as long as the orientation of the nozzle mask 142 relative to the wiping nozzle 141 can be maintained at the same relative angle according to the relative positional relationship between the wiping nozzle 141 and the nozzle mask 142. Accordingly, the rotation mechanisms may be another mechanism such as a ball catch mechanism.

In the above-described embodiment, the spring 1431*d*, the spring 1431*e*, and the spring 1434*b* are used. However, as long as the arm portion 1432 can be pulled or the rotating pin 1431*a* can be supported so as to be movable, other elastic members such as a plate spring and rubber may be used in addition to the coil spring.

Moreover, in the wiping device 14 according to the above-described embodiment, the nozzle mask 142 is guided in the direction of the wiping nozzle 141 by pulling the arm portion 1432 toward the spring support base 1434*a* side by the spring 1434*b*. However, the spring 1434*b* may be a spring which guides the wiping nozzle 141 by pushing the arm portion 1432 from the side opposite to the spring support base 1434*a*. Further, the spring 1434*b* may be directly connected to the arm portion 1432 without providing the spring support base 1434*a*.

INDUSTRIAL APPLICABILITY

The present invention is useful for the wiping device capable of preventing the edge overcoat and the splash at the end portion in the width direction of the steel sheet in a hot-dip plating step and the hot-dip plating device using the same.

BRIEF DESCRIPTION OF THE REFERENCE SYMBOLS

11: hot-dip plating device
12: hot-dip plating bath
13: sink roll
14: wiping device
141: wiping nozzle
141*a*: nozzle port
142: nozzle mask
143: support mechanism
1431: connection mechanism
1431*a*: rotating pin
1431*a*1: flange portion
1431*a*2: diameter-increasing portion
1431*b*: holding portion
1431*c*: guide portion
1431*d*, 1431*e*: spring
1431*f*: projection pin
1431*g*: through-hole
1431*h*: connection portion
1431*i*: first shaft member
1431*j*: fixing bolt
1432: arm portion
1432*a*: second shaft member
1432*b*: pin receiving portion
1432*c*: nut
1433: support portion
1433*a*: first support bar
1433*b*: second support bar
1434: spring mechanism
1434*a*: spring support base
1434*b*: spring
144: sensor
145: moving mechanism
1451: moving frame
1452: ball screw
1453: guide rail
146: pipe
15: alloying furnace
16: conveyance roll
P: steel sheet
F1: width direction
F2: axial direction

The invention claimed is:

1. A wiping device comprising:
a pair of wiping nozzles;
a pair of nozzle masks;
a pair of rotating pins;
a pair of holding portions; and
a pair of arm portions,
wherein each wiping nozzle of the pair of wiping nozzles has a respective nozzle port and the respective nozzle port of each wiping nozzle of the pair of wiping nozzles are disposed to face each other,
wherein each nozzle mask of the pair of nozzle masks is disposed at an end of the nozzle port of the respective wiping nozzle of the pair of wiping nozzles,
wherein each rotating pin of the pair of rotating pins is connected to an upper portion of the respective nozzle mask of the pair of nozzle masks,
wherein each holding portion of the pair of holding portions holds the respective rotating pin of the pair of rotating pins,
wherein each arm portion of the pair of arm portions fixes the respective holding portion of the pair of holding portions from above, and
wherein each rotating pin of the pair of rotating pins is rotatable around an axis and adjusts a position of the respective nozzle mask of the pair of nozzle masks.

2. The wiping device according to claim 1, further comprising:
a pair of support portions; and
a pair of springs,
wherein each arm portion of the pair of arm portions is oscillatably, connected to the respective one of the pair of support portions of the pair of support portions,
wherein each spring of the pair of springs is suspended between the respective support portion of the pair of support portions and the respective arm portion of the pair of arm portions, and
wherein each nozzle mask of the pair of nozzle masks is biased in a direction of the respective wiping nozzle of the pair of wiping nozzles by the respective spring.

3. The wiping device according to claim 2,
wherein each holding portion of the pair of holding portions is rotatably connected to the respective arm portion of the pair of arm portions, and the respective arm portion and the respective holding portion are fixed to each other by a respective bolt.

4. The wiping device according to claim 3,
wherein each holding portion of the pair of holding portions includes a respective projection pin, and each arm portion of the pair of arm portions includes a respective pin receiving portion into which the respective projection pin is inserted.

5. The wiping device according to claim 4,
wherein each holding portion of the pair of holding portions has a respective through-hole into which the respective rotating pin of the pair of rotating pins is inserted and movably holds the respective rotating pin along an axial direction of the respective rotating pin.

6. The wiping device according to claim 3,
wherein each holding portion of the pair of holding portions has a respective through-hole into which the respective rotating pin of the pair of rotating pins is inserted and movably holds the respective rotating pin along an axial direction of the respective rotating pin.

7. The wiping device according to claim 2, wherein each holding portion of the pair of holding portions includes a respective projection pin, and each arm portion of the pair of arm portions includes a respective pin receiving portion into which the respective projection pin is inserted.

8. The wiping device according to claim 7, wherein each holding portion of the pair of holding portions has a respective through-hole into which the respective rotating pin of the pair of rotating pins is inserted and movably holds the respective rotating pin along an axial direction of the respective rotating pin.

9. A hot-dip plating device comprising: the wiping device according to claim 2.

10. The wiping device according to claim 1, wherein each holding portion of the pair of holding portions is rotatably connected to the respective arm portion of the pair of arm portions, and the respective arm portion and the respective holding portion are fixed to each other by a respective bolt.

11. The wiping device according to claim 10, wherein each holding portion of the pair of holding portions includes a respective projection pin, and each arm portion of the pair of arm portions includes a respective pin receiving portion into which the respective projection pin is inserted.

12. The wiping device according to claim 11, wherein each holding portion of the pair of holding portions has a respective through-hole into which the respective rotating pin of the pair of rotating pins is inserted and movably holds the respective rotating pin along an axial direction of the respective rotating pin.

13. The wiping device according to claim 10, wherein each holding portion of the pair of holding portions has a respective through-hole into which the respective rotating pin of the pair of rotating pins is inserted and movably holds the respective rotating pin along an axial direction of the respective rotating pin.

14. A hot-dip plating device comprising: the wiping device according to claim 10.

15. The wiping device according to claim 1, wherein each holding portion of the pair of holding portions includes a respective projection pin, and the respective arm portion of the pair of arm portions includes a respective pin receiving portion into which the respective projection pin is inserted.

16. The wiping device according to claim 15, wherein each holding portion of the pair of holding portions has a respective through-hole into which the respective rotating pin of the pair of rotating pins is inserted and movably holds the respective rotating pin along an axial direction of the respective rotating pin.

17. A hot-dip plating device comprising: the wiping device according to claim 15.

18. The wiping device according to claim 1, wherein each holding portion of the pair of holding portions has a through-hole into which the respective rotating pin of the pair of rotating pins is inserted and movably holds the respective rotating pin along an axial direction of the respective rotating pin.

19. A hot-dip plating device comprising: the wiping device according to claim 1.

20. The wiping device according to claim 2, wherein each holding portion of the pair of holding portions has a through-hole into which the respective rotating pin of the pair of rotating pins is inserted and movably holds the respective rotating pin along an axial direction of the respective rotating pin.

* * * * *